United States Patent [19]

Wilson

[11] Patent Number: 4,901,849

[45] Date of Patent: Feb. 20, 1990

[54] WRAP-AROUND ARTICLE CARRIER WITH END PANEL LOCK

[75] Inventor: Jerry F. Wilson, West Monroe, La.

[73] Assignee: Manville Corporation, Denver, Colo.

[21] Appl. No.: 232,063

[22] Filed: Aug. 15, 1988

Related U.S. Application Data

[63] Continuation of Ser. No. 112,582, Oct. 26, 1987, abandoned.

[51] Int. Cl.[4] ..... B65D 65/06

[52] U.S. Cl. ..... 206/148; 206/427; 229/40

[58] Field of Search ..... 206/140, 141, 148, 149, 206/151, 152, 154, 155, 427, 434, 435, 145, 147; 229/40

[56] References Cited

U.S. PATENT DOCUMENTS 3,294,280 12/1966 Graser ..... 206/140 X
3,398,856 8/1968 Graser ..... 206/155
4,128,169 12/1978 Ameson ..... 206/141
4,437,606 3/1984 Graser ..... 229/40
4,597,523 7/1986 Schuster ..... 229/40

*Primary Examiner*—Bryan P. Gehman
*Attorney, Agent, or Firm*—John D. Lister

[57] ABSTRACT

A wrap-around article carrier having end panels foldably connected to tuck flaps for holding the end panels in position. A center gradually triangular tuck flap is foldably connected to the top panel and to two generally triangular tuck flaps. The fold lines connecting the end tuck flaps to the center tuck flap contain cutouts, one edge of which comprises part of an edge of the center tuck flap and overlies the top of an article in the carrier to lock the tuck flaps and the end panels in place. The other cutout edge comprises part of an edge of the end tuck flaps and is positioned to contact the side of an article to stabilize the structure.

4 Claims, 3 Drawing Sheets

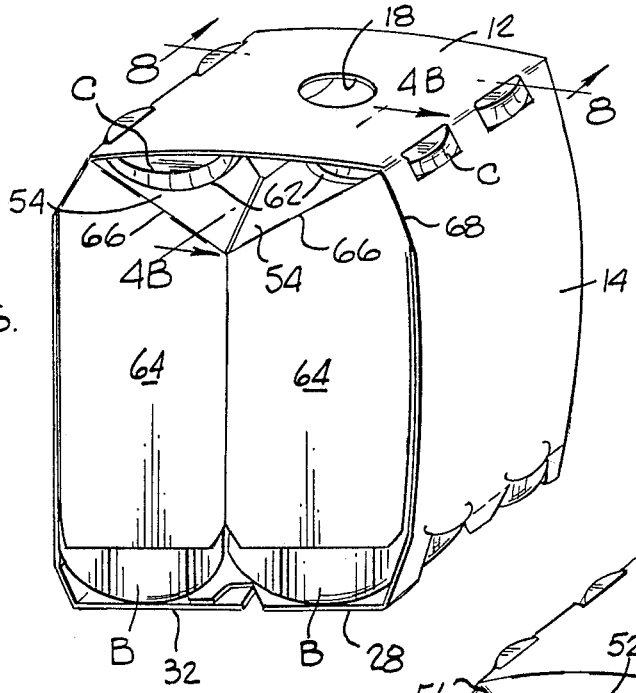
FIG.6.
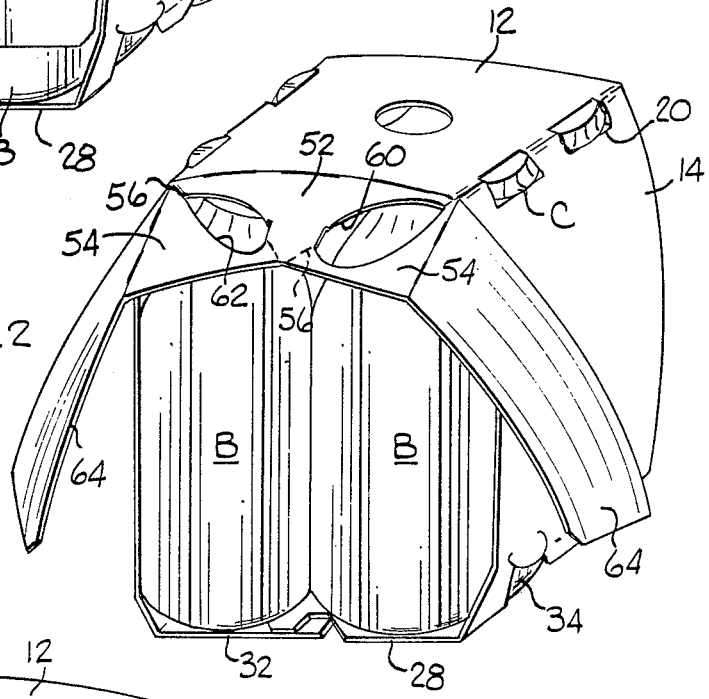
FIG.2
FIG.3
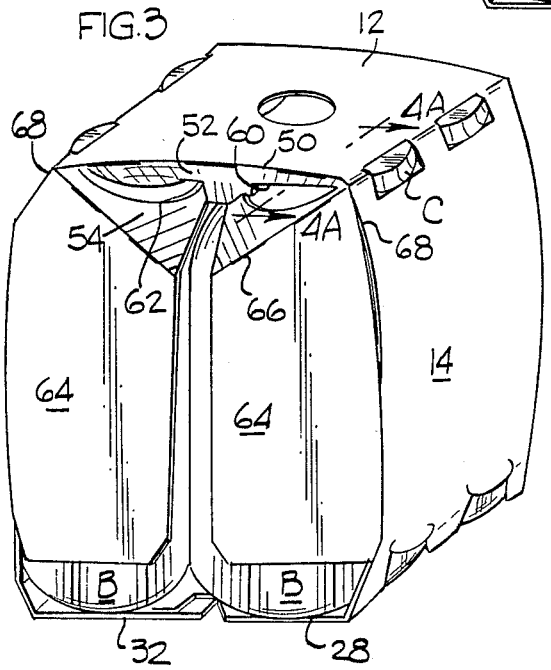

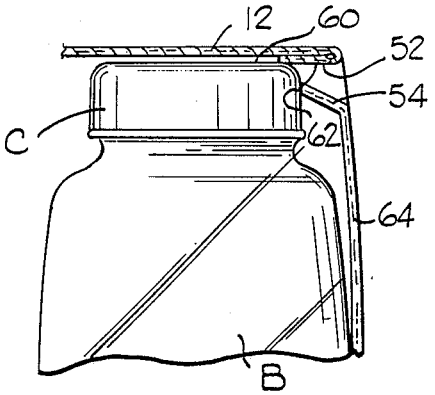
FIG. 4B
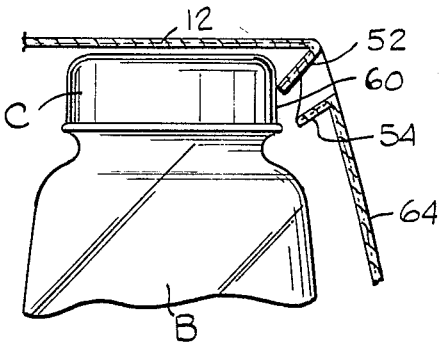
FIG. 4A
FIG. 5.
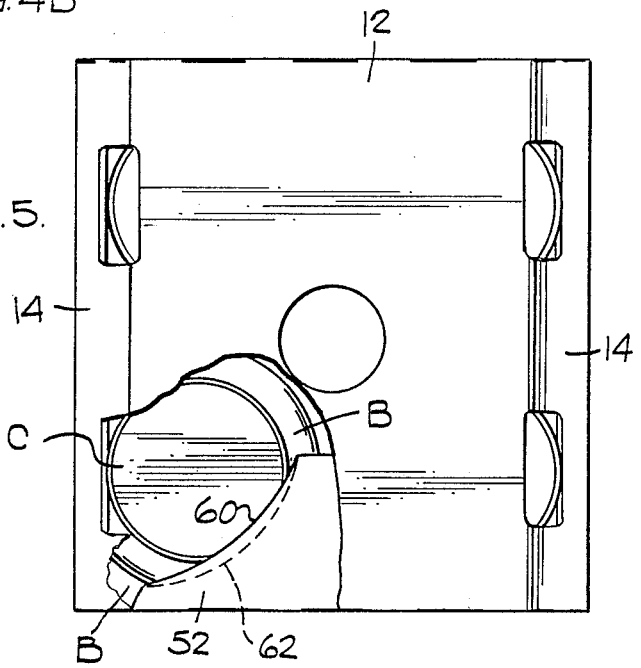
FIG. 7
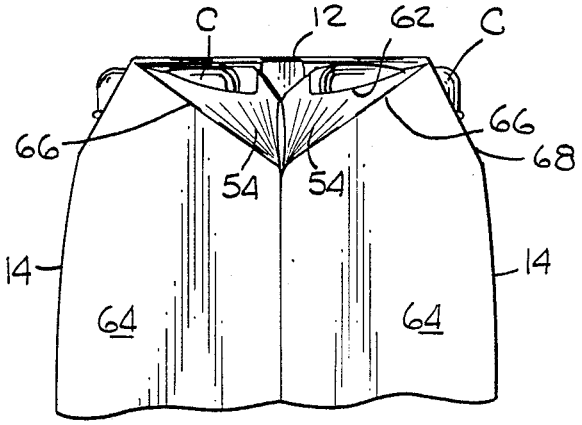
FIG. 8
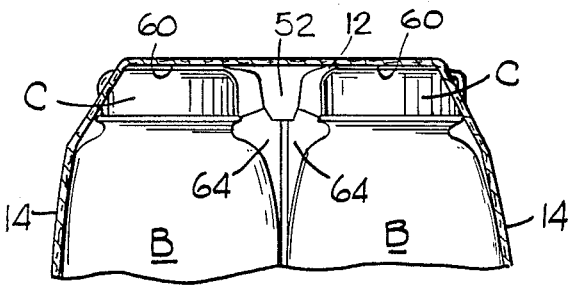

WRAP-AROUND ARTICLE CARRIER WITH END PANEL LOCK

This is a continuation of application Ser. No. 07/112,582, filed Oct. 26, 1987, now abandoned.

FIELD OF THE INVENTION

This invention relates to wrap-around article carriers which have end panels that are unattached to the bottom panel. More particularly, it relates to a wrap-around article carrier of this type which incorporates an improved locking means for holding the end panels in place.

BACKGROUND OF THE INVENTION

Wrap-around beverage container carriers are available in many different styles and designs, some of which include end panels. End panels offer more area for printed material and also protect the labels on bottles from being scuffed or otherwise damaged during passage of the bottles through the packaging machine and during subsequent handling. In order to provide these functions at a minimum of expense, end panels have been used which do not fully cover the ends of the carriers and which are not connected at their bottom edges to the bottom panel of the carrier, thus reducing the amount of paperboard required for each carrier blank. End panels of this type are normally foldably connected to tuck panels which themselves are foldably connected to the top and side panels of the carrier. This arrangement requires that the carrier be designed so as to prevent the end panels from unfolding and springing out from their generally vertical position.

A number of different arrangements have been suggested to provide this function. For example, U.S. Pat. No. 3,398,856, issued on Aug. 27, 1968 to Graser, discloses an end panel arrangement comprised of three foldably connected tuck flaps, the central tuck flap having edges which are designed to frictionally engage the necks of beverage bottles to hold the flaps and the end panels in place. While this design works well with beverage bottles having necks for the central tuck flap to engage, it could not be used effectively with bottles having no necks. Bottles of this type have wide openings and are shaped more like a jar, leaving little or no room for engagement with a tuck flap.

It would be desirable to use wrap-around carriers of the type discussed to package beverage containers having no necks, and still be able to incorporate locking means for maintaining the end panels of the carriers in place.

BRIEF SUMMARY OF THE INVENTION

This invention incorporates end panels which at least partially cover the ends of the carrier and which are foldably connected to tuck flap means. The tuck flap means is foldably connected to the top panel along the end edge thereof, and a portion of the tuck flap means extends between the adjacent article in the carrier and the top panel of the carrier to lock the tuck flap means and the attached end panels in place.

This arrangement can be carried out with a generally triangular center tuck flap and two generally triangular end tuck flaps connected to the center tuck flap along a fold line. Cutouts in the fold lines produce edges on the center tuck flap which are adapted to overlie portions of adjacent articles between the article top and the top panel. The cutouts also produce edges on the end tuck flaps which are adapted to engage the sides of the adjacent articles a short distance below the top of the article to further support the tuck flaps.

Other features and aspects of the invention, as well as its various benefits, will become more clear in the details description of the preferred embodiment which follows.

BRIEF DESCRIPTION OF THE INVENTION

FIG. 2 is a pictorial view of a carrier of the present invention in an intermediate stage of formation resulting from wrapping the blank of FIG. 1 around four bottles and securing the bottom panels together;

FIG. 3 is a pictorial view similar to that of FIG. 2, but showing the end panels in the final stage of folding;

FIG. 4A is an enlarged partial longitudinal sectional view taken along line 4A—4A of FIG. 3, showing the tuck flaps as they are being folded to their final positions;

FIG. 4B is an enlarged partial longitudinal sectional view taken along line 4B—4B of FIG. 6, showing the tuck flaps and the end panel in their final folded positions;

FIG. 5 is a top view of a fully formed carrier, with a portion of the top panel removed to show the tuck flap arrangement with respect to an adjacent bottle;

FIG. 6 is a pictorial view of a fully folded carrier formed from the blank of FIG. 1;

FIG. 7 is a partial end view of the carrier of FIG. 6; and

FIG. 8 is a partial sectional view taken along line 8—8 of FIG. 6.

DESCRIPTION OF THE PREFERRED EMBODIMENT

Figure 1:
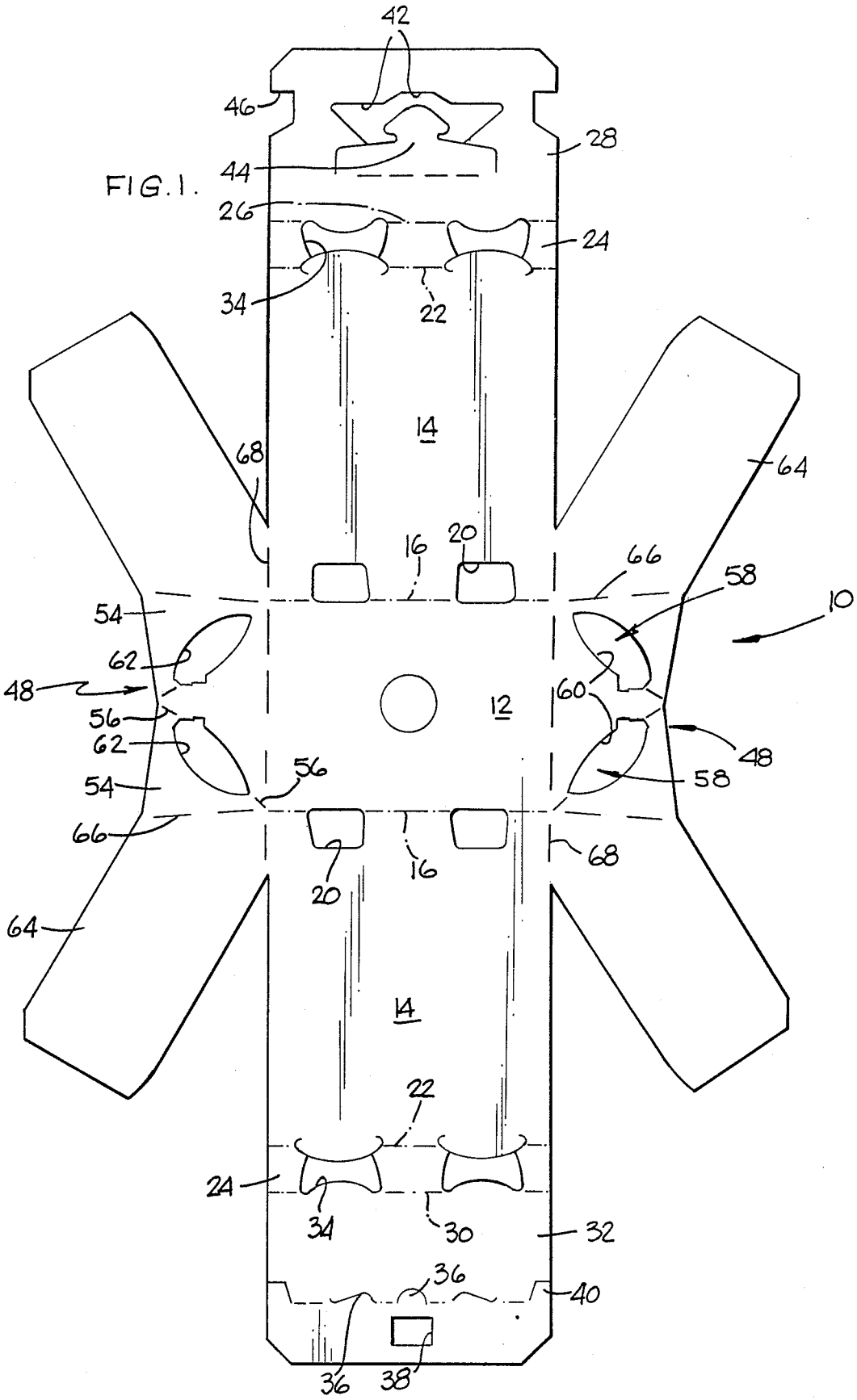
FIG. 1 is a plan view of a production blank used in forming the carrier of the present invention.

Referring to FIG. 1, a carrier blank 10 is comprised of a top panel section 12 foldably connected to side panel sections 14 along score lines 16. The top panel section may be provided with a suitable handle, which for purpose of illustration is shown as a finger hole 18. The side panel sections are also provided with cutouts 20 adjacent the score lines 16 for receiving the tops or bottle caps of containers packaged in the carrier. Although in this case the blank is shown as being designed to form a carrier for holding four containers, the invention is not limited to use in a four-pack carrier.

Both side panel sections are connected by score lines 22 to short sloped side panel sections 24, one of which is connected by score line 26 to an inner bottom panel section 28 and the other of which is connected by score line 30 to an outer bottom panel section 32. Cutouts 34 in the sloped sections 24 allow the heel portions of containers packaged in a carrier formed from the blank to extend therethrough to assist in holding the containers in place. The outer bottom panel section 32 is illustrated as having alternate primary male locking tabs 36, a secondary locking aperture 38 and tertiary locking tabs 40. The inner bottom panel section 28 is illustrated as having alternate primary locking edges 42, a secondary male locking tab 44 and tertiary female locking openings or notches 46. These locking components do not form a part of the present invention but are used to lock the bottom panel sections together to form the bottom panel of a carrier in a manner understood in the industry. For a more complete description of related locking components and their functions, attention is directed to U.S. Pat. No. 4,437,606, issued Mar. 20, 1984 to Graser.

Still referring to FIG. 1, the end edges of the top panel section 12 are connected to tuck sections 48 along fold lines 50. Each tuck section is comprised of a generally triangularly shaped center tuck flap 52 connected to the top panel section along the fold line 50 and two generally triangularly shaped end tuck flaps 54 connected to the center tuck flap along fold lines 56. It can be seen that the fold lines 56 are interrupted by cutouts 58 bounded by center tuck flap edges 60 and end tuck flap edges 62. Each of the cutout edges is curved to conform to the shape of the bottles or other containers to be carried in the carrier. End panel sections or flaps 64 are connected to end tuck flaps 54 along fold lines 66 and to the side panel sections 14 along fold lines 68. The fold lines 66 represent the edges of the end tuck flaps 54 and are shown as extending at a slight angle to the score lines 16. The fold lines 68 are extensions of the edges of the side panel sections 14.

In practice, the blanks 10 are supplied to an automatic packaging machine which wraps the blanks around the beverage containers and secures the bottom panel sections together to form the intermediate form of carrier shown in FIG. 2. As illustrated, the tuck flaps 52 and 54 extend outwardly from the top panel 12 and the end panel sections or flaps 64 extend outwardly at an angle to the tuck flaps and to the side panels 14. The bottles B are securely held in the carrier by a combination of pressures, snugly fitting between the side panels 14 and partially extending through the heel cutouts 34. The caps C of the bottles partially extend through the cap cutouts 20 to further assist in holding the bottles in place.

Pressure applied by a packaging machine element (not shown) against the outermost portion of center tuck flap 52 causes the tuck flap 52 to fold inwardly about score line 50, carrying with it the end tuck flaps 54. This also causes the end panel flaps 64 to fold inwardly about the fold lines 68. The fold lines 66 allow relative folding movement between the end panel flaps 64 and the end tuck flaps 54, and the fold lines 56 allow relative folding movement between the center tuck flap 52 and the end tuck flaps 54, such relative movements taking place as a consequence of the movement of the center tuck flap 52.

A final intermediate stage in the folding of the flaps is shown in FIGS. 3 and 4A. As the center tuck flap is folded inwardly, the edges 60 and 62 of the cutouts separating the center tuck flap 52 and the end tuck flaps 54 swing through an arc carrying them in toward the bottles and up toward the top panel of the carrier. Eventually, the cutout edges 60 of the center tuck flap 52 engage the sides of the caps C, as best shown in FIG. 4A. At this point the cutout edges 62 of the end tuck flaps 54 have not yet reached the bottles B. Continued folding movement of the tuck flaps finally causes the portions of the center tuck flap 52 immediately adjacent the edges 60 to flex past the upper edges of the caps C and the edges 62 to assume a position abutting or spaced immediately adjacent from the sides of the caps. This final position is shown best in FIGS. 4B and 5. The flexing of the center tuck flap past the bottle cap is possible because the edge 60 extends in only a short distance over the edge of the cap and because the material of the carrier, preferably paperboard, permits such flexing to take place.

The completed carrier resulting from continued folding movement of the tuck flaps and end panel flaps is shown in FIGS. 4B, 5, 6, 7 and 8. The end panel flaps 64 are substantially vertical and the cutout edges 62 are adjacent the lower portion of the caps C. The cutout edges 62 may be in actual abutting contact with the caps C or may be slightly spaced therefrom. In either case, when the carrier is lifted by the finger hole 18 or other handle means which may be provided on the top panel, the lifting stresses tend to pull the end tuck flaps 54 and the cutout edges 62 in toward the caps C. As a result at least parts of the cutout edges 62 abut the caps C of the end bottles during lifting and carrying of the carrier to provide firm support for the end tuck flaps and the end panels and to provide additional stabilizing support to hold the bottles in place. The portions of the center tuck flap overlying the bottle caps C are trapped in the small space between the top panel 12 and the bottle caps and are thus locking in place. Since they cannot move from this position the tuck panels and attached end panels cannot be moved from their final positions, and the carrier retains its desired shape until the consumer removes the bottles from the carrier.

A number of modifications may be made to the carrier of the present invention if desired. For example, tear strips can be provided to facilitate removal of the bottles. In addition, score lines can be provided in the side panels to cause the side panels to conform more readily to the sloped shape of the bottles between the caps and the barrel portion of the bottles, although the side panels will normally conform to the bottle outline even without such fold lines if properly dimensioned. Further, the length of the end panels may be varied as desired, since the locking means of the invention will function to hold any length of end panel in place at substantially right angles to the top and bottom panels of the carrier.

Although the invention has been disclosed in connection with bottles or jars having little or no neck portions, it should be understood that it can be used in connection with any container or article which extends substantially completely from the bottom panel to the top panel and which does not extend upwardly through a support opening in the top panel.

It should now be obvious that although a preferred embodiment of the invention has been described, changes to specific details of the embodiment, including but not limited to the modifications mentioned above, may be made without departing from the spirit and scope of the invention as defined in the appended claims.

What is claimed is:

1. A wrap-around article carrier, comprising:
a top panel having side edges and end edges;
side panels foldably connected to the side edges of the top panel;
a bottom panel connecting the side panels;
the carrier containing two adjacent rows of articles, the tops of which extend substantially to the top panel;
end panels at least partially covering the ends of the carrier; and
tuck flap means for holding the end panels in place, the tuck flap means being foldably connected to the end edges of the top panel and to the end panels;
the tuck flap means including first edge portions overlying the tops of adjacent contained articles and engaging the top panel of the carrier and second edge portions adjacent the sides of the articles;

the tuck flap means at each end of the carrier comprising a generally triangular center tuck flap foldably connected to the associated end edge of the top panel and two generally triangular end tuck flaps foldably connected to the center tuck flap along fold lines, the first and second edge portions of the tuck flap means being connected to the fold lines;

the fold lines connecting the end tuck flaps to the center tuck flap being interrupted by a cutout having spaced opposed edges, one of the spaced opposed edges of each cutout defining the first edge portions of the tuck flap means and the other spaced opposed edge of each cutout defining the second edge portions of the tuck flap means.

2. A production blank for forming a wrap-around carrier adapted to carry two adjacent rows of articles, the tops of which are at least closely adjacent to the underside of the top panel, comprising:

a top panel section having end edges and side edges;

side panel sections foldably connected to the side edges of the top panel section and to bottom panel sections;

generally triangular center tuck flaps foldably connected to the end edges of the top panel section;

generally triangular end tuck flaps foldably connected to the center tuck flaps;

the foldable connections between the center tuck flaps and the end tuck flaps containing cutout portions defining spaced opposed edges, one of the opposed edges of the cutout comprising an edge of the center tuck flap and the other opposed edge comprising an edge of the foldably connected end tuck flap;

the cutout edges of the center tuck flap being adapted to extend between the top panel of a carrier formed from the blank and the tops of adjacent articles carried by the carrier; and the cutout edges of the end tuck flaps being adapted to terminate adjacent the sides of the adjacent articles carried in the carrier.

3. A production blank according to claim 2, including end panel sections foldably connected to the end tuck flaps and to the side panel sections adjacent the top panel section, the end panel sections being adapted to at least partially cover the ends of a carrier formed from the blank.

4. A production blank according to claim 2, wherein the opposed edges of the cutouts comprise concave curved portions for use with articles having curved side portions, at least part of the curved edge portions of the center tuck flaps being adapted to contact and slide up the curved side portions of adjacent articles as the center and end tuck flaps are folded inwardly during the forming of a carrier around the adjacent rows of articles.

* * * * *